United States Patent [19]

Scarffe

[11] 4,048,816

[45] Sept. 20, 1977

[54] NEEDLE SELECTION MECHANISM

[75] Inventor: Michael Scarffe, Bletchley, England

[73] Assignee: Camber International (England) Limited, England

[21] Appl. No.: 713,987

[22] Filed: Aug. 12, 1976

[30] Foreign Application Priority Data

Aug. 21, 1975 United Kingdom ..... 34704/75

[51] Int. Cl.[2] ..... D04B 15/78

[52] U.S. Cl. ..... 66/50 R

[58] Field of Search ..... 66/50 R, 50 B, 75 A, 66/154 A, 207

[56] References Cited

U.S. PATENT DOCUMENTS

| | | | |
|---|---|---|---|
| 2,414,080 | 1/1947 | Amidon | 66/207 |
| 3,423,960 | 1/1969 | Wiesinger et al. | 66/154 A X |
| 3,824,809 | 7/1974 | Canderton et al. | 66/50 R |
| 3,877,255 | 4/1975 | Allavena | 66/50 R X |

FOREIGN PATENT DOCUMENTS

| | | | |
|---|---|---|---|
| 2,118,406 | 10/1972 | Germany | 66/50 R |
| 546,847 | 3/1974 | Switzerland | 66/75 |
| 1,358,381 | 7/1974 | United Kingdom | 66/50 R |
| 1,368,697 | 10/1974 | United Kingdom | 66/50 R |

*Primary Examiner*—Wm. Carter Reynolds

*Attorney, Agent, or Firm*—Larson, Taylor and Hinds

[57] ABSTRACT

A needle selector mechanism for a knitting machine and a knitting machine embodying such a needle selector mechanism. The mechanism includes a cam assembly arranged to be driven in synchronism with a main drive for a knitting machine, a control member of said cam assembly being engageable with one of two jack selector slides each of which slides is operatively engageable with a knitting needle to thereby move said needle into one of a plurality of working positions, and electromagnetic control means selectively operable upon the control member to cause said member to releasably latch with one of said jack selector slides in accordance with a predetermined knitting pattern.

8 Claims, 5 Drawing Figures

NEEDLE SELECTION MECHANISM

The present invention relates to a needle selection mechanism for a knitting machine, more especially a multi-feed circular knitting machine.

The need for a needle selection mechanism in accordance with the invention arose in an attempt to increase the pattern area of a fabric on a circular multi-feed knitting machine. Such a machine has an axially tricked needle cylinder tricked to receive individually operable knitting needles and a set of suitably corresponding pattern jacks furnished with patterning butts adapted to be acted upon selectively by prearranged jack selector slides disposed in vertical banks - usually one bank in advance of each feed.

In a circular knitting machine of this kind the selective action of the pattern jacks is for the purpose of exercising such selective individual control over the needles that whilst predetermined ones are permitted to remain down and non-knit, others are raised, e.g. either to clearing height so that they knit, or to an intermediate height so that they tuck, all according to knitting requirements.

The patterning butts on the pattern jacks, one butt per jack, are commonly so disposed in a multiplicity of superimposed planes as to enable the butts in any one horizontal plane to be well spaced apart circumferentially: in such an arrangement, the butts on successive jacks are so relatively offset laterally in the superimposed plane as to be in echelon formation right around the machine, i.e., to present circumferentially spaced and parallel lines of butts diagonally.

Conventional needle selection mechanisms, such as those disclosed in commonly assigned U.S. Pat. No. 3,824,809, have jack selector slides which are normally spring-biased towards a knitting position and which are positively displaced from that position by a comb. It was found that needle selection mechanisms embodying spring-biased jack selector slides were unsuitable when used at the high speeds consequent upon the use of increased pattern areas. Springs rendered the mechanisms "slow", were prone to breakage and were generally unreliable.

According to the invention there is provided a needle selector mechanism for a knitting machine comprising a cam assembly arranged to be driven in synchronism with a main drive for a knitting machine, a control member of said cam assembly being engageable with one of two jack selector slides each of which slides is operatively engageable with a knitting needle to thereby move said needle into one of a plurality of working positions, and electromagnetic control means selectively operable upon the control member to cause said member to releasably latch with one of said jack selector slides in accordance with a predetermined knitting pattern.

The cam assembly may include two cams or cam lobes and a single, desmodromic, cam follower which is always in contact with both cams and is mounted for rectilinear movement controlled by the cams, the control member being pivotally or resiliently mounted on said cam follower.

The control member, which is made from a magnetisable material such as spring steel, may be common to the two jack selector slides. In this arrangement the member is elongated and pivotally mounted on the cam follower, one end of the member carrying a pair of latches each of which is releasably latchable in a respective latching surface on each of the jack selector slides. In an alternative arrangement two control members are provided each associated with an individual jack selector slide. In this arrangement each control member is a leaf spring one end of which is fixedly mounted to the cam follower, a latch being provided adjacent the other end of the leaf spring for releasable latching with a latching surface on the associated jack selector slide. The latch may be a cut-out or, alternatively, a separate latch, conveniently of a harder material than that of the leaf spring, and which is fixed to the leaf spring by rivets for example.

An interlock may be provided for causing rectilinear motion imparted to one jack selector slide to be imparted to the other slide as well, the interlock being such that rectilinear motion applied to the other jack selector slide is not imparted to said one jack selector slide.

The pattern jacks, the position of which is controlled by the jack selector slides, may either be slidably mounted in axial tricks in a jack cylinder or, alternatively, rockable in axial tricks in a jack cylinder, both in known manner and both to control the working positions of the knitting needles. The working positions of the needles are positions corresponding with knitting, non-knitting or miss, and a tucking position.

The electromagnetic control means may comprise a pair of electro-magnets arranged adjacent the or each control member. Where a single pivotted control member is used in a mechanism having an interlock, in an unenergised condition of the electro-magnets the knitting machine needles are all at a knitting position; energisation of one electro-magnet causes pivotal displacement of the control member to releasably latch one jack selector slide to bring an operated upon needle to a tucking position; energisation of the other electro-magnet causing pivotal displacement of the control member in the opposite direction to displace both jack selector slides, via the interlock, and allow an addressed needle to remain in a non-knitting position.

The above movements also apply to a needle selection mechanism having two control members each in the form of a leaf spring.

It will be appreciated that energisation of the electromagnets is in accordance with a preselected knitting programme which is stored in a memory bank or store, conveniently a machine controller.

The needle selection mechanisms of the invention may each be mounted in a common housing in which a plurality of mechanisms are stacked vertically. Each housing may be closed and packed with a lubricant such as grease prior to installation.

Where the knitting machine is a multi-feed circular knitting machine a plurality of stacks of needle selector mechanisms may be provided which stacks are angularly spaced around the machine.

The invention will be described further by way of example with reference to the drawings in which.

Figure 1:
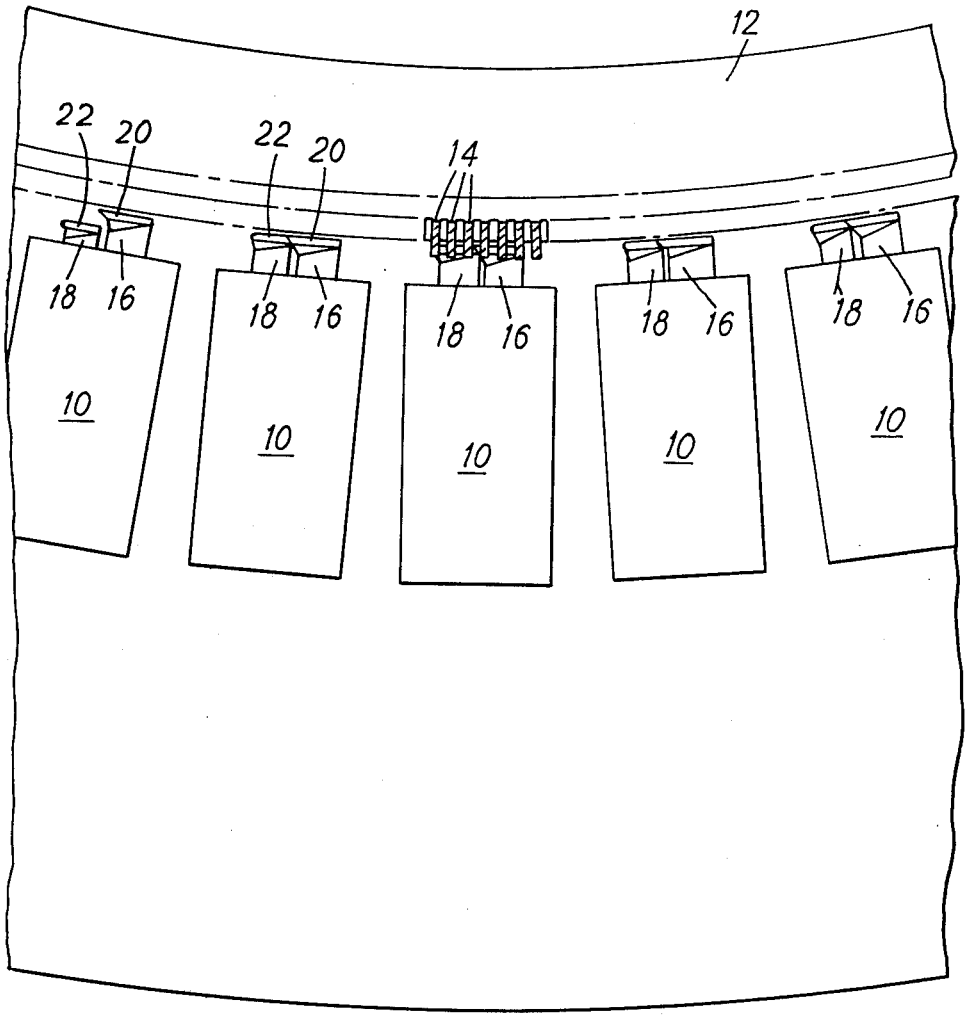
FIG. 1 is a diagrammatic view showing part of a multi-feed cylindrical knitting machine with a plurality of needle selection mechanisms in accordance with the invention fitted thereto.

The locations of a plurality of needle selection mechanisms 10 each in accordance with the present invention are shown diagrammatically in FIG. 1 in position upon a multi-feed circular knitting machine. The knitting cylinder is axially tricked to receive respective needles each of which is provided with a butt to enable the position of individual needles to be controlled within their respective tricks in known manner. Pattern jacks corresponding in number to the number of needles are similarly accommodated in tricks in a separate jack cylinder designated 12 which is coaxial with, and of larger diameter than, the needle cylinder and which rotates therewith.

Each pattern jack has a patterning butt 14 displaceable by the needle selector mechanism of the invention to enable the needle associated therewith to be brought into a knitting, non-knitting or miss, or a tucking position. The selector mechanism has two jack selector slides 16, 18 disposed side-by-side and which constitute tucking and knitting slides. The jack selector slides have sloped cam faces 20, 22 which are of different heights, and the positions of the slides is selectively controlled in a manner to be described hereafter to thus determine the position of the needles.

Figure 2:
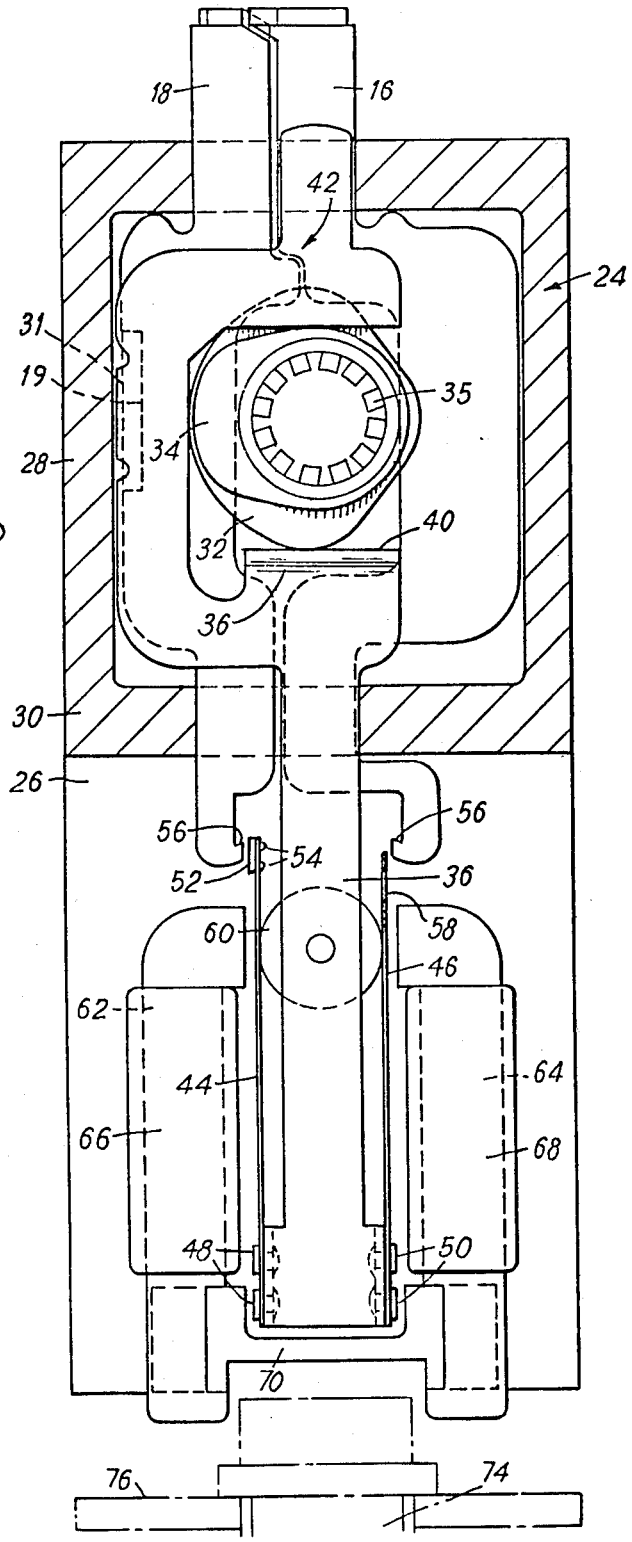
FIG. 2 is a plan view of a needle selection mechanism in accordance with a preferred embodiment of the invention.
Figure 3:
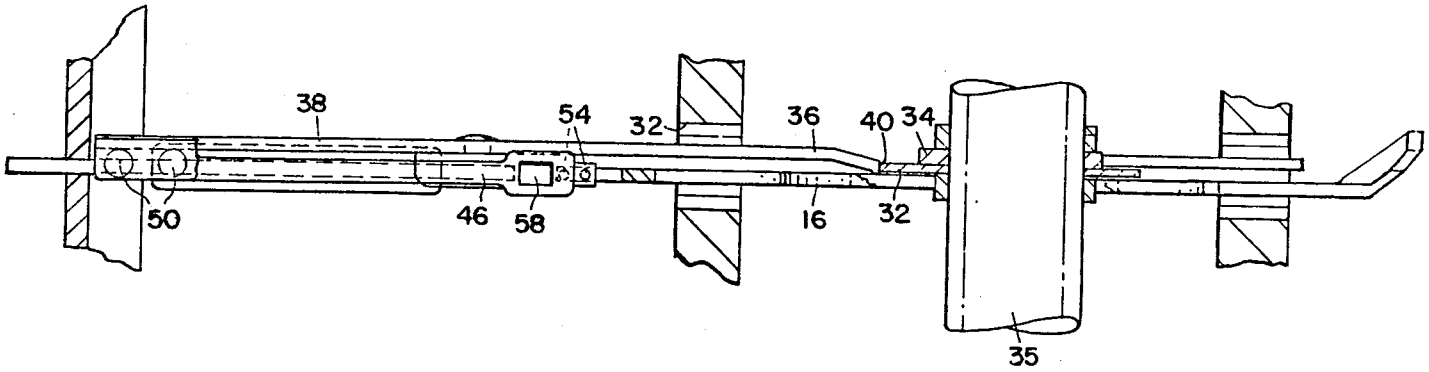
FIG. 3 is a side elevational view of the mechanism shown in FIG. 2.

Referring now to FIGS. 2 and 3 it will be seen that the selector mechanism shown is mounted in a common hollow housing 24 for all the needle selector mechanisms, the housing having a peripheral wall 28. The housing is seated on a base plate 26. Opposed ends 30 of the wall 28 are apertured and slidably mount the jack selector slides 16, 18. A top plate (not shown) is provided which closes the housing 24.

A cam assembly is mounted generally above, as viewed in FIG. 3, the jack selector slides 16, 18 and consists of two cams or lobes mounted fast relative to each other, the lower cam being designated 32 and the upper cam 34, both cams being driven through a splined shaft 35 by the main drive to a knitting machine to which the mechanism is fitted. The splined shaft 35 is mounted in bearings carried by the above referred to top and bottom plates. The cam assembly also includes a cam follower 36 which is mounted in parallelly spaced relationship with the slides 16, 18 and includes a generally C-shaped portion which partially encloses and engages the cams at all times. The cam follower also includes a straight portion 38 which extends outside the wall 30 of the housing and forms a tail for the cam follower. The upper cam 34 and the cam follower lie in substantially the same plane. The lower part of the C-shaped portion, as viewed, is stepped downwards to provide a flat 40 against which an operative portion of the lower cam 32 engages. It will be seen therefore that, in operation, the cam follower is continuously reciprocated in a rectilinear manner by the cam assembly.

The selector slide 18 is cut-away at 19 and a tab part 31 of the cam follower 36 is bent down to engage in the cut-out. The cut-out is longer than the tab 37 to permit some relative movement between the follower and slide.

The jack selector slides 16, 18 are stepped one relative to the other to provide an interlock, shown generally at 42. Thus the slide 16 may move forward independantly of the slide 18 but if the slide 18 is moved forward, the slide 16 is also raised by virtue of the interlock.

Leaf springs 44, 46 are made from spring steel and are fixedly secured to the tail portion of the cam follower by rivets 48, 50. In practice the leaf springs would be identical but, for the purposes of explanation, two different leaf springs are shown. The leaf 44 has a latch 52 made from a harder material than spring steel rivetted thereto by rivets 54, in use, the latch 52 engaging over a latching surface 56 on the slide 18.

The leaf spring 46, on the other hand has a cut-out portion 58, which, in use, engages over the latching surface 56 of the slide 16. A cylindrical body 60 of a non-magnetic material and of a diameter slightly greater than the distance by which the leaves are spaced apart serves to dampen any tendency of the leaf springs to oscillate during operation.

An electromagnetic assembly is provided adjacent the tail portion 38 and the leaf springs 44 and 46. The assembly consists of two formers 62, 64 which are manufactured from an electromagnetic material such as Swedish iron and are generally parallelly disposed relative to the leaf springs 44, 46 and portions of the formers being shaped round towards the leaf springs at positions adjacent the body 60. The formers carry respective windings 66, 68 which are each connected to an appropriate source of electrical power through a memory device, which is conveniently a machine controller (FIGS. 4 and 5), and which contains a knitting pattern or programme, the windings thus being energised according to the stored pattern. The two formers 62, 64 are bonded in a slotted member 70. The slotted member 70 is itself fastened to the top and bottom plates which form part of the enclosure for the selector mechanisms. The electrical connections to the windings are fed in a conduit (not shown) which terminates in a plug 74 fixed to a flange 76.

Figure 4:
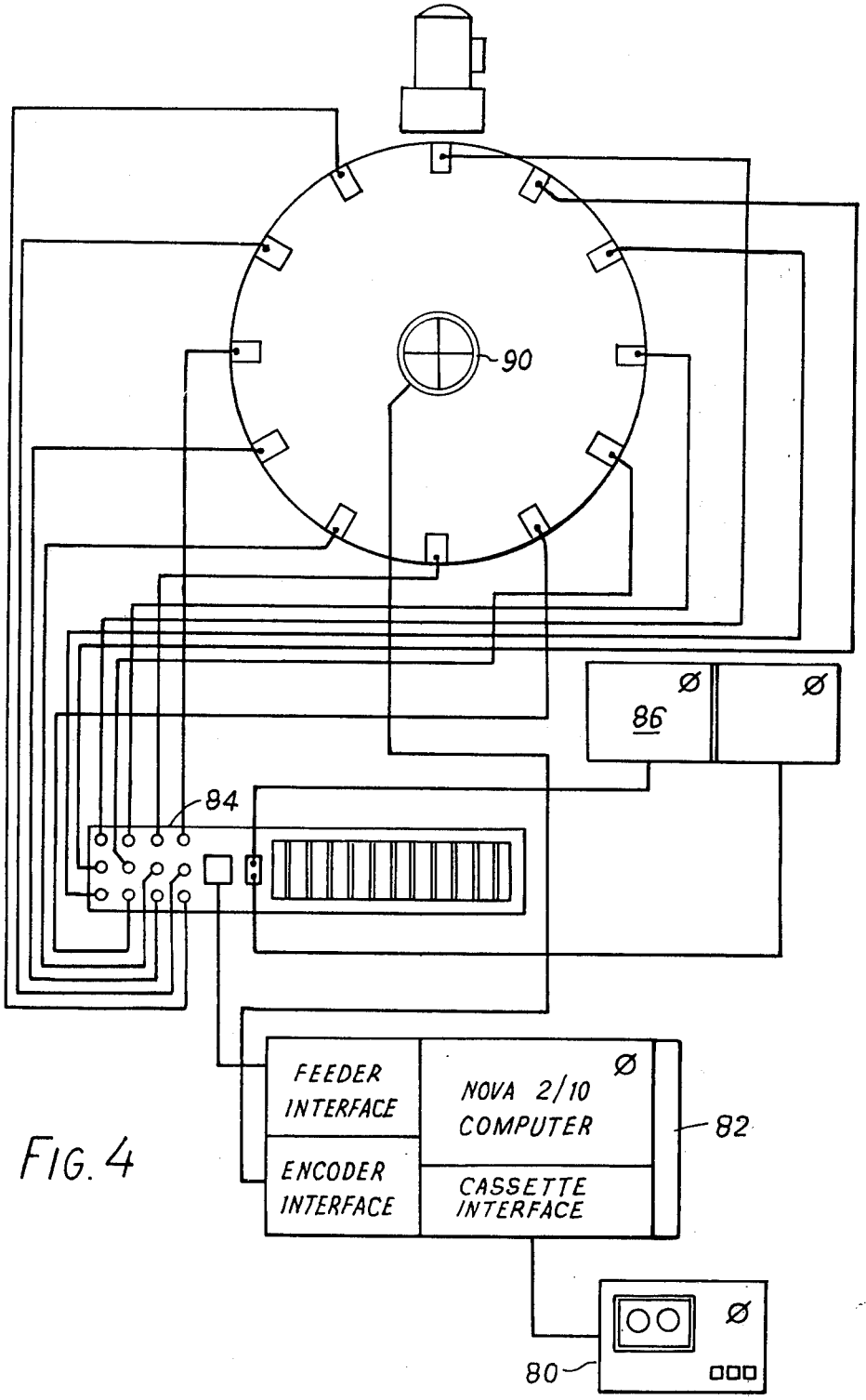
FIG. 4 is a diagrammatic illustration of a machine controller for issuing control signals to a plurality of needle selection mechanisms of the invention and as applied to a multi-feed circular knitting machine, and FIG. 5 gives details of the connections to the solenoid winding.

The machine controller is explained with respect to FIG. 4 in which a plurality of stacks of needle selector mechanisms 10 are disposed in an angularly spaced relationship around a multi-feed circular knitting machine. The machine controller shown in FIG. 4 consists essentially of a cassette reader unit 80, a computer 82 and a decoder-amplifier 84. Patterning information is stored on a magnetic tape (not shown) and this information is read by the cassette reader unit 80 which transmits the patterning information, in the form of appropriate electronic signals, onto a cassette interface in the computer 82. This information is processed in the computer and fed from a feeder interface thereof to the decoder-amplifier 84. Essentially, the decoder-amplifier has two input terminals for each selector mechanism. Where, as in the illustrated embodiment, there are a plurality of stacks of mechanisms and each stack includes, say 24 mechanisms, the No. 1 mechanism in each of the stacks are connected in electrical parallel relationship as are the No. 2 mechanisms and so on. Moreover, since it is found that the No. 12 mechanism is 180° out of phase with the No. 1 mechanism, No. 12 mechanism in each stack is connected in parallel with No. 1 mechanism and No. 2 mechanism in parallel with No. 13 and so forth.

Figure 5:
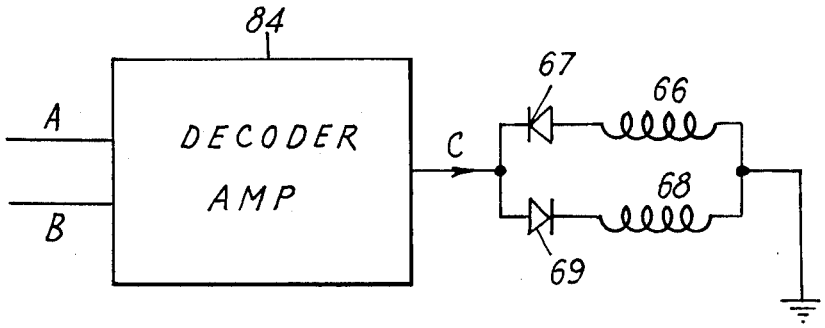

The input terminals A and B to the decoder-amplifier 84 carry signals representing 0 or 1 in binary code on either terminal and the decoder 84 has a single output C which can be the +ve, or −ve or zero potential with respect to earth connected to the two windings 66, 68 described hereinabove in the manner shown in FIG. 5.

A signal KNIT, for example, has the code $A = 0, B = 0$; MISS $- A = \mathbf{O}, B = 1$; and TUCK $- A = 1, B = 0$. Thus, an input signal to A and B of, say, $A = 0, B = 1$, would for example cause output C to go positive with respect to earth. This would cause diode 67 only to conduct thereby energising winding 66. Similarly, an $A = 1, B = 0$ signal representing tucking would cause C to go negative with respect to earth thus causing diode 69 to conduct thereby energising winding 68 only.

It is to be understood that needle selection occurs when two conditions are fulfilled:

a. appropriate electrical signals are issued from the computer to the windings of the electromagnets, and b. the cam assembly is at such a position that it can act in response to the electrical signals.

Thus the electrical signals may be issued at a period in time when the cam assembly cannot respond but, once the cam assembly is in a given position and can respond to the electrical signal, the appropriate needle selection signalled by the computer is made.

A shaft encoder 90 is provided on the knitting machine and gives an output signal, in binary form, of an absolute needle position relative to the rotation of the machine. This information is fed into the computer 82 through an encoder interface and thus the computer is able to synchronise scanning of the pattern with the knitting speed.

In operation, the cam assembly rotates synchronously with the main drive to the knitting machine and thus reciprocates the cam follower continuously as described above one revolution of the cam to each pitch of selector butts in echelon formation. It will be appreciated that the cam follower is thus driven positively by the cams during each of its reciprocal strokes. When the pattern requires the knitting machine needles to deviate from a knitting condition, i.e. a non-knitting or tucking condition, one or other of the windings 66 and 68 is energised, dependent upon the condition required, to cause the leaf springs 44, 46 to latch onto the latching surfaces 56 of the slides 18, 16 as appropriate. The relevant slide or slides is thus moved, by virtue of the latching action between the appropriate leaf spring on the control member and the appropriate latching surface 56, to shift the knitting needle to a tuck height or, alternatively, allow it to pass undisturbed in a non-knitting condition through the appropriate pattern jack.

It is preferred that the movement transmitted from the jack selector slides to the pattern jacks is amplified prior to application to the knitting needles as described in the above referenced U.S. Pat. No. 3,824,809, although this step is not an essential feature of the present invention.

It will be appreciated that the invention is not restricted to the case where the cam assembly uses two cams of lobes since the assembly may embody one cam or more than two cams as may be required.

In a modification of the invention (not shown) shims are interposed between the two jack selector slides 16, 18 at the positions where they pass through the wall 28. The shims serve to prevent frictional contact between the two slides and thus movement imparted to one slide being transferred to the other.

I claim:

1. A needle selector mechanism for a knitting machine having a main drive therefor comprising:

a cam assembly arranged to be driven in synchronism with said main drive, the cam assembly including two cams or cam lobes and a single cam follower which is arranged to be always in contact with both cams and is mounted for rectilinear movement controlled by the cams;

two jack selector slides each operatively engageable with a knitting needle of said knitting machine to move said needle into one of a plurality of working positions;

two control members, each of said control members being associated with an individual jack selector slide and comprising a leaf spring one end of which is fixedly mounted to the cam follower;

a latch on each control member adjacent the other end of the leaf spring for releasable latching with a latching surface on the associated jack selector slide; and electro-magnetic control means selectively operable upon each control member to cause said member to releasably latch with its associated jack selector slide in accordance with a predetermined knitting pattern.

2. A needle selector mechanism as set forth in claim 1 wherein the latch is a cut-out.

3. A needle selector mechanism as set forth in claim 1 wherein the latch is a separate component from the leaf spring and of a harder material than that of the leaf spring, the latch being fixedly secured to the leaf spring.

4. A needle selector mechanism as set forth in claim 1 wherein the electromagnetic control means comprises a pair of electro-magnets one of which is arranged adjacent to each control member.

5. A multi-feed circular knitting machine including a plurality of needle selector mechanisms arranged in stacks at angularly spaced locations around the periphery of said machine, said machine including a main drive therefor, wherein the improvement comprises a cam assembly for each mechanism driven in synchronism with said main drive, a single cam follower, two cam or cam lobes of said assembly being arranged in permanent contact with both said cams and mounted for rectilinear movement controlled by said cams, a control member of said assembly being engageable with one of two jack selector slides each of which slides is operatively engageable with a knitting needle of said knitting machine to thereby move said needle into one of a plurality of working positions, and electromagnetic control means selectively operable upon said control member to cause said member to releasably latch with one of said jack selector slides in accordance with a predetermined knitting pattern.

6. A multi-feed circular knitting machine as set forth in claim 5 in which each said stack of needle selector mechanisms are contained within a common housing.

7. A multi-feed circular knitting machine as set forth in claim 6 in which each said common housing is packed with a lubricant.

8. A multi-feed circular knitting machine as set forth in claim 5 wherein said control means embodies a plurality of electro-magnets the energisation of which is in accordance with a preselected knitting programme stored in a machine controller.

* * * * *